US009765453B2

(12) United States Patent
Deng et al.

(10) Patent No.: US 9,765,453 B2
(45) Date of Patent: Sep. 19, 2017

(54) SPINNING, CHEESE DYEING, KNITTING AND WEAVING PROCESS OF A HIGH PERFORMANCE FLAME-RESISTANT MODACRYLIC/COTTON SAFETY APPAREL FABRIC

(71) Applicant: Guangdong Kingtide Development Co., Ltd., Guangzhou, Guangdong Province (CN)

(72) Inventors: Shaomin Deng, Guangzhou (CN); Li Zhang, Guangzhou (CN)

(73) Assignee: GUANGDONG KINGTIDE DEVELOPMENT CO., LTD., Guangdong (CN)

( * ) Notice: Subject to any disclaimer, the term of this patent is extended or adjusted under 35 U.S.C. 154(b) by 867 days.

(21) Appl. No.: 13/762,403

(22) Filed: Feb. 8, 2013

(65) Prior Publication Data

US 2014/0196201 A1 Jul. 17, 2014

(30) Foreign Application Priority Data

Jan. 16, 2013 (CN) ..... 2013 1 0015565

(51) Int. Cl.

| | |
|---|---|
| ***D06P 3/66*** | (2006.01) |
| ***D06P 3/76*** | (2006.01) |
| ***D06P 1/00*** | (2006.01) |
| ***D02G 3/44*** | (2006.01) |
| ***D06P 3/82*** | (2006.01) |

(52) U.S. Cl.

CPC ..... *D02G 3/443* (2013.01); *D06P 1/00* (2013.01); *D06P 3/66* (2013.01); *D06P 3/76* (2013.01); *D06P 3/8204* (2013.01); *D10B 2201/02* (2013.01); *D10B 2321/101* (2013.01)

(58) Field of Classification Search

CPC ... D06G 3/443; D06P 1/00; D06P 3/66; D06P 3/76; D06P 3/8204; D10B 2201/02; D10B 2321/101

See application file for complete search history.

(56) References Cited

U.S. PATENT DOCUMENTS

| | | | | |
|---|---|---|---|---|
| 3,414,957 | A * | 12/1968 | Langstaff | D02G 1/18 28/156 |
| 3,960,477 | A * | 6/1976 | Harper, Jr. | D06P 3/66 8/449 |
| 4,264,993 | A | 5/1981 | Freeman | |
| 4,931,065 | A * | 6/1990 | Baumgarte | D06P 1/5278 8/188 |
| 6,620,212 | B1 * | 9/2003 | Handermann | D02G 3/36 428/370 |
| 2006/0292953 | A1 * | 12/2006 | Ashley | A41D 31/0022 442/197 |
| 2011/0308022 | A1 | 12/2011 | Li | |

* cited by examiner

*Primary Examiner* — Amina Khan

(57) ABSTRACT

The present invention relates to flame retardant fabrics and safety apparel, especially yarn used for high flame resistant safety apparel fabric wherein the yarn uses a cheese method and the yarn is used to weave fabric. The fabric as described contains at least 60% high flame resistant modacrylic fiber which after cheese dyeing is woven into fabric. The safety apparel that use this fabric will not continue to burn after leaving a fire, will not melt or cause the wearer secondary injury and complies with the relevant standards of the European Union, the United States and China.

4 Claims, No Drawings

SPINNING, CHEESE DYEING, KNITTING AND WEAVING PROCESS OF A HIGH PERFORMANCE FLAME-RESISTANT MODACRYLIC/COTTON SAFETY APPAREL FABRIC

BACKGROUND OF THE INVENTION

1. Field of the Invention

The present invention relates to the field of flame resistant fabric and safety apparel, especially the yarn for high flame resistant safety apparel fabric, cheese dyeing of the yarn, knitting and weaving of the fabric using the yarn as described.

2. Description of the Prior Art

Increased Worldwide Health and Safety working practices have recognized the need for safety apparel for occupational workers from high-risk industries, and have developed a series of FR testing methods and standards that safety apparel should meet such as non-flammable, non-melting, anti-static, arc flame resistant as well as high visibility standards for people working in high risk industries.

SUMMARY OF THE INVENTION

In order to accommodate the requirements above, the present invention manufactures safety apparel using suitable high flame resistant modacrylic/cotton fabrics and high visibility flame retardant modacrylic cotton fabrics that comply with the relevant standards for safety and comfort for the majority of high-risk industrial practices.

In order to achieve the above aim, the present invention uses the following technical process to produce yarn for high flame resistant modacrylic/cotton safety apparel fabric, the yarn containing at least 60% of high flame resistant modacrylic fibers which has LOI (Limiting Oxygen Index) of 32-34%.

The yarn for high flame resistant safety apparel fabrics, is processed by picking→assorting→cleaning→carding→pre-drawing→combing→drawing→roving→spinning→coning→doubling→twisting.

As described, the present invention is used in the body of the yarn for high flame resistant modacrylic/cotton safety apparel fabrics. The yarn also contains combed cotton.

As described, the present invention is used for protective apparel fabrics of high flame resistant modacrylic/cotton yarns containing the following compositions:

1. 60% modacrylic/40% cotton;
2. 60% modacrylic/37%-40% cotton with anti-static blend (anti-static yarn or fibre≤3%);
3. 60% modacrylic/35% cotton/5% nylon;
4. 60% modacrylic/32-35% cotton/5% nylon with anti-static blend (anti-static yarn or fibre≤3%);
5. 60% modacrylic/30-32% cotton/5% nylon/3-5% aramid;
6. 60% modacrylic/29-32% cotton/5% nylon/3% aramid with anti-static blend (anti-static yarn or fibre≤3%);
7. 100% modacrylic At present the yarn invented for high flame resistant woven safety apparel fabric has a count of 20S/2-45S/2, the twist is 77.5-86.67 T/10 CM, and S twist; the yarn count for knitted fabric is 10S-40S, twist is 56-66 T/10 CM, and Z twist.

The invention includes a cheese dyeing method for the yarn described, the dyeing procedures are as follows:

Grey yarn→coning→loading→pre-processing→dyeing→post-processing→hydro extraction→drying→coning dyed yarn→packaging;

Pre-processing includes kier boiling with wetting agent and alkaline powder;

There are two stages in the dyeing process, the first stage is to dye the modacrylic fiber with cationic dyes, the second stage is to dye the cotton fiber with reactive dyes (where there is a cotton blend).

Dyes and chemicals used to color the invention of high flame resistant yarn for fluorescent yellow are:

The Cationic dyes used are:
Cationic Y10GFF: 0.6-0.8%;
Cationic Y7GL: 0.005-0.01%;
The dye method auxiliaries for the modacrylic dyeing are:
Acetic acid, 0.2-0.5 g/L;
Leveling agent 0.2-0.5 g/L;
Reactive dyes used are:
Reactive dye YHD-8GL: 0.3-0.6%;
Reactive dye TBG190: 0.0005-0.002%;
The dye method auxiliaries for the cotton dyeing are:
Sodium chloride: 30-50 g/L;
Sodium carbonate 10-30 g/L;

Dyes and chemicals used to color the invention of high flame resistant yarn for fluorescent orange:

The Cationic dyes are:
Cationic 10GFF: 0.4-0.7%;
Cationic 5GN: 0.05-0.085%;
The dye method auxiliaries for the modacrylic dyeing are:
Acetic acid: 0.2-0.5 g/L;
Leveling agent: 0.2-0.5 g/L;
The reactive dyes used are:
Reactive CF-GN: 2-2.8%;
Reactive HD-8GL: 0.15-0.25%;
The dye method auxiliaries for the cotton are:
Sodium chloride: 30-50 g/L;
Sodium carbonate 10-30 g/L;

Dyes and chemicals used to color the invention of high flame resistant yarn for black are:

The Cationic dyes used are:
Cationic Y x-GL: 0.6-0.8%;
Cationic R x-GRL: 0.1-0.5%,
Cationic B x-BL: 0.7-0.9%;
Dye method auxiliaries for the modacrylic are:
Acetic acid: 0.3-0.5 g/L;
Leveling agent: 0.3-0.5 g/L;
Reactive dyes used are:
Reactive Y M3R150%: 0.2-0.6%;
Reactive R 3BNJ: 0.1-0.4%;
Reactive B KG: 10-20%;
Dye method auxiliaries for the cotton are:
Sodium chloride: 50-80 g/L;
Sodium carbonate: 10-30 g/L;

Dyes and chemicals used to color the invention of high flame resistant yarn for navy blue are:

The Cationic dyes used are:
Cationic Y x-GL: 0.2-0.4%;
Cationic R x-GRL: 0.1-0.5%;
Cationic B x-BL: 1-2%;
Dye method auxiliaries for the modacrylic are:
Acetic acid: 0.3-0.5 g/L;
Leveling agent 0.3-0.5 g/L;
Reactive dyes used are:
Reactive Y M3R150%: 0.3-0.6%;
Reactive R 3BNJ: 0.4-0.8%;
Reactive B KG: 1-2%;
Dye method auxiliaries for the cotton are:
Sodium chloride: 50-80 g/L;
Sodium carbonate: 10-30 g/L.

The invented dye method for the high flame resistant yarn follows the following procedure:

Step 1—dye the modacrylic fibers with cationic dye: dissolve the cationic dye in hot water heat to 70° C., then add the cationic dye auxiliaries, running 5-10 min, then raise bath temperature to 100° C. at 1° C./minute, hold temperature at 100° C. for approximately 60 minutes, then slowly cool down at 1° C./minute to about 60° C. with cold water, hold temperature at 60° C. for approximately 30-40 minute, take a sample to approve the modacrylic color, rinse loose dye:

Step 2—dyeing the cotton fibers with reactive dyes: pour dissolved reactive dyes and Sodium carbonate powder into the bath, adjust pH value to 9, raise the temp to 60° C., hold temp at 60° C. for approximately 30 minutes, add sodium chloride and sodium carbonate step by step, until the pH value is 4-9, fix the color by holding for 30 min, take sample to approve color; rinse loose dye on the fiber surface with soaping agents.

The present invention provides a dyed yarn through cheese dyeing described as above. The present invention also provides a high flame resistant modacrylic/cotton safety fabric made from the yarn described above. Weaving process of the yarn described, including twisting antistatic filaments with the dyed yarn. The fabrics comply with EU Eco-textiles OKO-TEX STANDARD100 standard; meet the EU flame retardant standard EN11612 and EN11611; comply with EU Standards Institute of EN471 standard for high-visibility safety apparel, and EU EN1149 standard for antistatic; They also meet standards of American Society for Testing and Materials flame retardant textiles ASTM F-1506, and/or American National Standards Institute (ANSI)/ISEA-107 standard for high visibility safety apparel.

Finally, the present invention also provides safety apparel made of high flame resistant fabric as described above.

Compared with the existing technology, the yarn as described in the invention used for high flame resistant safety apparel fabrics uses modacrylic or modacrylic fiber blends with combed cotton and other fibers to obtain strength and high flame resistant properties; uses the cheese dyeing method described in the present invention achieves the required color fastness; twists antistatic filaments with dyed yarn, then weaves the twisted yarn into fabric, the antistatic property of fabric are improved; safety clothing made with this fabric will not continue to burn after leaving a naked flame, it will not melt, it will not drip.

These and other objectives of the present invention will no doubt become obvious to those of ordinary skill in the art after reading the following detailed description of the preferred embodiment that is illustrated in the various figures and drawings.

DETAILED DESCRIPTION

In order to better illustrate the present invention, connection with the embodiment examples below for further explanation.

The production of high fire-resistant safety apparel fabrics including fiber selected, the spinning process, the cheese dyeing process and the weaving process.

1. The Fiber Selected

The present invention uses high flame resistant modacrylic fiber that is produced by the Fushun Ruihua Fiber Company, the specification is 1.5 D/TEX*38 MM. During the production process, antimony pentoxide colloid and dimethylformamide aqueous are added in the polymerization dope, after sufficient mixing, the antimony and chlorine in the copolymer become the important component of the modacrylic fibre which also give it the flame resistant property. Limiting Oxygen Index of this fiber can be varied from 28-34%, but for making protective clothing, fibers of high Limiting Oxygen Index of 32-34% must be chosen to meet the relevant requirements.

2. The Spinning Process

The static of the modacrylic fiber makes the spinning more difficult. Therefore, spinning oil is needed in the pretreatment procedure. After the spinning, oil is widely applied under certain a humidity, the fiber should be covered for 24-48 hours before the start of the spinning process. However, due to the application the spinning oil may affect the fiber absorbancy and make the fiber difficult to dye, this spinning oil must be easy to emulsify, easy to wash, and have low viscosity. Otherwise it will lead to roller contamination in the spinning process and affect the quality of the yarn.

Standards Fabric WeightWoven Fabric WeightKnitted Breaking Strength Tear Strength Bursting Strength ASTM F1506 3-5.9 oz/y2 134 min, N 11 min, N 3-8 oz/y2 179 min, N 6-8.4 oz/y2 179 min, N 18 min, N 8.1-16 oz/y2 268 min, N>8.5 oz/y2 223 min, N 22 min, N

EN11611 NA 400N 20N NA 2000N/$M^2$

EN11612 NA 300N 15N NA 2000N/$M^2$

EN471 NA 400N 25N NA 8000N/$M^2$

Secondly, the European Union and the United States Association of flame retardant textiles have strict requirements for flame retardant clothing strength, Therefore, high quality combed cotton must be used to ensure that the yarn strength meets the relevant standards.

Furthermore, for fabric needing a higher strength and thermal protection requirement, 5% nylon and/or 3-5% aramid fibers can be added to improve wear resistance and thermal protective performance.

For fabric with an antistatic requirement, 3% Belltron® antistatic staple fiber (3D-51-638 or 3D-76-B31) can be blended. This can also be achieved by twisting Belltron® (22T-3-B68 or 22T-3-9R1) antistatic filament yarn with it.

The present invention uses yarn containing at least 60% of high flame resistant modacrylic fibers, after blending with different fibers for different end use requirements, the composition of the yarn could be as follows:

1) 60% modacrylic/40% cotton;
2) 60% modacrylic/37% cotton with anti-static blend (anti-static yarn or fibre≤3%);
3) 60% modacrylic/35% cotton/5% nylon;
4) 60% modacrylic/32-35% cotton/5% nylon with anti-static blend (anti-static yarn or fibre≤3%);
5) 60% modacrylic/30-32% cotton/5% nylon/3-5% aramid;
6) 60% modacrylic/27-32% cotton/5% nylon/3-5% aramid with anti-static blend (anti-static yarn or fibre≤3%);
7) 100% modacrylic The yarn count and the yarn twist above should meet the following requirements:

Yarn count for woven fabric varies from 20S/2 to 45S/2, twist of yarn for woven fabric is 77.5-86.67 T/10 CM, and twist direction is S twist.

Yarn count for knitted fabric varies from 10S to 40S, twist of yarn for knitted fabric is 55-66 T/10 CM, and twist direction is Z twist.

The twist of the yarn is adjusted according to the thickness of the yarn count.

The yarn spinning process including picking→assorting→cleaning→carding→pre-drawing→combing→drawing→roving→spinning→coning→doubling→twisting steps.

3. Cheese Dyeing Process

The European Union and the American Association of flame retardant textiles and National Standards Institute have high requirements for color fastness of the flame resistant and high visibility safety apparel, including washing fastness, staining fastness, wet/dry rubbing fastness, color fastness to perspiration should be no less than grade 4-5, so we use the bobbin dyeing to meet the standard.

The bobbin dyeing process: grey yarn→pine coning→(chamfer)→load yarn→(compress yarn)→(pre-treatment)→dyeing→post processing→dehydration→drying→(coning)→packaging (1) Grey Yarn The grey yarn should be checked for appearance, strength and composition before dyeing.

(2) Coning

The diameter of winding (diameter should be ≤17 CM), tightness, density (0.35≤D≤0.38) are decided according to different requirements. These machines can bulk up the fiber for dyeing. It can reduce dye time and improve efficiency. The dye house laboratory provide lab dips for approval prior to bulk production.

(3) Chamfering

For atmospheric type yarn dyeing, yarn density of bobbin at both ends of the outermost (the cheese shoulder) is high, but dye flow is less. To ensure the invariant flow of dye, the hard shoulder should be chamfered round to reduce the density of the shoulder. For high pressure dyeing, chamfering is not a requirement.

(4) Loaded Yarn

Bobbins are loaded into the dye vessel according to required optimum batch size and given a batch number. The dye vessel is then closed and sealed appropriately.

(5) Pressing the Yarn

For high pressure dyeing, compress 5%-30% of the total height of cheese, as a whole, ensure each dye column compression rate is consistent to achieve the same yarn density.

(6) Pre-Treatment

For modacrylic/cotton yarn, the pre-treatment is primarily washing away the oils added in the spinning process, as well as grease, dust and any other contaminants. Oils are essentially removed as they can contain emulsifying agents and antistatic properties that will resist dye and cause poor color fastness and unlevel dye on the surface of the yarn.

Wetting agent and soda powder is used for kier boiling in the pre-treatment procedure to remove the oil and other impurities on the surface of the yarn, to give the yarn more luster after cheese dyeing and to improve color clarity.

Pretreatment requires the use of 3 g/L of soda powder, 2 g/L refined enzyme, 0.5 g/L wetting agent, at 90° C., the bath ratio of 1:10, kier boiling for 10 min.

(7) Dyeing

The invention can be used to dye 100% high flame resistant modacrylic yarn and modacrylic blended yarn. Different colors can be dyed, such as high visibility fluorescent yellow, fluorescent orange, yellow, red, orange, blue and etc. Different compositions have different dyeing orders. Two-batch dyeing for cationic dyes and reactive dyes can prevent residual dye in the bath.

Modacrylic dyeing principle: modacrylic-COOH+H+modacrylic-COO-⁻+H++D+modacrylic-COOD Modarylic dyeing is cationic dye. Dyeing modacrylic is a combination of salt link, hydrogen link and ionic link.

First Step—Dye Modacrylic Fiber a) fluorescent yellow dyeing recipe:
Cationic Y10GFF: 0.6-0.8%;
Cationic Y7GL: 0.005-0.01%;
Acetic acid: 0.2-0.5 g/L;
Leveling agent 0.2-0.5 g/L;

b) fluorescent orange dyeing recipe:
Cationic 10GFF: 0.4-0.7%,
Cationic 5GN: 0.05-0.085%;
Acetic acid: 0.2-0.5 g/L;
Leveling agent: 0.2-0.5 g/L;

c) other color dyeing recipe:
Cationic dyes: X1%;
Acetic acid: 0.2-0.5 g/L;
Leveling agent: 0.3-0.5 g/L;

After the cationic dye is dissolved and heated to 70° C., add auxiliaries to the dye bath, run 5~10 min, the bath temperature is raised to 100° C. at 0.5° C. a minute and held for 60 minutes. Cooled the bath to about 60° C. with cold water at 2 degrees a minute, a color sample is then taken for approval. Rinse to remove the loose dye and ensure good color fastness.

B. Second Step—Dye Cotton Fibers a) fluorescent yellow dyeing recipe:
Reactive dyes YHD-8GL: 0.3-0.6%;
Reactive dye TBG190: 0.0005 to 0.002%;
Sodium chloride 30-50 g/L;
Sodium carbonate 10-30 g/L;

b) fluorescent orange dyeing recipe:
Reactive CF-GN: 2-2.8%;
Reactive HD-8GL: 0.15-0.25%;
Sodium chloride: 30-50 g/L,
Sodium carbonate 10-30 g/L.

c) other color dyeing recipe:
Reactive dyes: X2%;
Sodium chloride: 50-80 g/L;
Sodium carbonate: 10-30 g/L;

Pre-dissolved reactive dye and anhydrous sodium carbonate are added to the bath, to adjust the pH value to 9. Raise the temperature to 60° C., and hold for 30 min. Evenly add sodium chloride and sodium carbonate and control the pH value between 4-9. Once the pH is correct, hold for a further 30 minutes. Then take color sample again to confirm the color. Once color has been approved the bath is rinsed several times with soap and water. This removes any surface dye and ensures good color fastness. The color fastness is then checked. Thereafter soft finishing is applied to ensure good "handle".

(8) Hydro Extraction

To remove excess water after dyeing, the Cones are placed evenly in a high speed centrifuge for approximately 10 minutes to reduce water content to 45%. This improves drying time and efficiency.

(9) Drying

Drying has to be carried out at the correct speed. If the speed is too slow, the drying time will be too long, and can cause yarn discoloration; if the speed is too fast, the yarn moisture will be too high to make rewinding difficult. RF drying speed is 6 m/h, after being left for 24 hours to condition. Check the yarn color, color fastness, strength and bobbin uniformity after drying. After completion of inspection, the yarn is rewound with equal and low tension, slow speed.

4. The Weaving Process

Fabric for safety apparel is monitored by strict requirements for tear strength, breaking strength, bursting strength, seam strength. This can also be achieved by controlling the weight of the fabric. Before weaving the fabric, a suitable fabric weight should be designed to comply with the requirements of different levels of safety clothing.

For fabric with antistatic requirement, there are basically four types of methods:

a. adding antistatic additive;
b. blend antistatic staple fiber while spinning the yarn;
c. weave the antistatic filament yarn at the back of the fabric;
d. twist the antistatic filament yarn with the colored yarn and weave into the fabric;

For the first method, the antistatic properties will slowly disappear after several washes;

For the second method, the costs are high and uneconomic;

For the third method, antistatic filaments are easily exposed and destroyed after washing and with contact with the inner garment lining or skin.

The weaving process of the present invention is the fourth method stated above. By twisting the antistatic filament with the dyed yarn, then weaving the twisted yarn into the fabric, the antistatic properties will not be affected by repeated washes, the antistatic filament is not easily exposed, and the performance and comfort of the fabric is maintained.

Weaving methods of the present invention, the woven fabric and knitted fabric weaving processes are as following.

A: Woven Fabric

1. Weaving Processes

Twist dyed yarn with antistatic filament→drawing-in-→healding→reed-in→test weaving→dropper pinning-→discharge fabric→inspect the grey fabric.

2. Finishing Process

Finishing process include: Washing→Heatsetting→Sanforizing

Washing: 80° C. wash with soap, then hydro extraction.

Heatsetting:

feed fabric→dewing→cylinder roller drying—stenter drying→discharge of the fabric.

Oven temperature: 170° C., speed: 36 m/min.

Pre-Shrinking Process:

feed fabric→steam damping→Rubber coated compression rollers with adjustable pressure→discharge of the fabric→inspection→roll the fabric.

The rubber pressure: 3 KG, speed: 30 m/min, temperature: 80° C.

B: Knitted Fabric

1. Knitting Process:

Twist dyed yarn with the antistatic filament→put the yarn ball into the shack→yarn tensioner→yarn feeding→midway tensioning→yarn-feeding→discharge fabric→fabric fed into the cloth rack→roll the fabric.

Various specifications of finished knitted fabric are as below:

a. Pique fabric weight: 210-280 gsm, Width: 200-220 cm, yarn Count: 18-20 s/l.
b. fleece fabric weight: 300-450 gsm, width: 180 cm Yarn: 10-20 s/l.
c. rib fabric weight: 210-500 gsm, width: 170 cm Yarn: 10-32 s/l.
d. single jersey fabric weight: 210-250 gsm width: 180 cm Yarn: 18-20 s/l.

2. Finishing Process:

Washing→setting

Washing process: color fabric washing; water temperature around 60-70° C., add detergent 209 of 2%, washing about 15-30 min→Rinse with water (once)→Rinse with water again with softener (1-2%)→Hydro extraction→tumble dry.

After relax drying, the fabric is prepared for heat setting, the stenter temperature is 150-160° C., width of stenter is set (the width of the fabric 2-3 cm wider than the finished fabric), warp overfeed (2 to 4%). Overfeed size will ensure the required gsm, improve fabric shrinkage→enter the pin frame, the setting speed 30 seconds→cooling temperature <50° C.→inspection→roll the fabric.

The finished woven and knitted fabrics are used to make safety work wear (in fluorescent yellow, orange or other solid colors) including coverall, jacket, trousers, shirt, polo shirt, sweat shirt, thermal under wear, vests, hoods, etc. The designs of the work wear made from the invention are to conform to relevant requirements for flame retardant clothing of Unites States of America for personnel working in a potentially hazardous environment.

Unless otherwise noted, the dye content and yarn content in the embodiment refers to is the weight percentages.

EXAMPLES

Example 1—Fluorescent Yellow 60% Modacrylic/40% Combed Cotton

Use 60% high flame resistant modacrylic, 40% combed cotton through picking→assorting→cleaning→carding-→pre-drawing→combing→drawing→roving→spinning-→coning→doubling→twisting steps, make the modacrylic/cotton grey yarn.

Cheese dyeing the yarn, through pine coning→loading yarn→pre-treatment→dyeing→post processing→hydro extraction→drying→coning→packaging steps; pre-treatment use wetting agent and soda powder for the kier boiling. That is yarn in the 3 g/L of soda powder, 2 g/L refined enzyme, 0.5 g/L wetting agent, at 90° C., the liquor ratio of 1:10, kier boiling for 10 min.

Dye the modacrylic fiber: dissolve the cationic Y10GFF 0.7% and Y7GL 0.006% and heat to 70° C., adding acetic acid (0.2-0.5 g/L) and leveling agent (0.2-0.5 g/L) to the dye bath, run 5~10 min, the bath temperature is heated to boiling at a rate of 0.5° C. per minute, then the temperature is held for 60 min, then the bath is cooled to about 60° C. with cold water slowly at a rate of 1° C. per minute. After 30 minutes the dyeing of the modacrylic is complete. A color sample is taken for shade approval. Rinse to remove the loose dye and ensure good color fastness.

Then dye the cotton fiber, adding the pre-dissolved reactive dye YHD-8GL 0.5% and TBG190 150% of 0.0005%. and anhydrous sodium sulfate, to adjust the pH=9, the temperature is raised to 60° C., the temperature is held for 30 min. Add sodium chloride and sodium carbonate, make pH value to 4-9, after about 30 min a sample is taken for color approval. Then make several rinses with soap to remove any surface loose color. Unload and prepare for drying after hydro extraction.

Example 2—Dye Fluorescent Orange 60% Modacrylic/40% Combed Cotton Yarn

Use 60% high flame resistant modacrylic, 40% combed cotton, through picking→assorting→cleaning→carding-→pre-drawing→combing→drawing→roving→spinning-→coning→doubling→twisting steps make out the modacrylic/cotton grey yarn.

Then cheese dyeing the yarn, including grey yarn→pine coning→load yarn→pre-treatment→dyeing→post processing→hydro extraction→drying→coning→packaging steps; Use wetting agent and soda powder for pretreatent kier boiling. That is yarn in the 3 g/L of soda powder, 2 g/L refined enzyme, 0.5 g/L wetting agent, at 90° C., the liquor ratio of 1:10, kier boiling for 10 min.

Then dye the modacrylic fiber: dissolve the cationic 10GFF 0.4~0.7% and 5GN 0.05~0.085% and heat to 70° C., add acetic acid (0.2-0.5 g/L) and levelling agent (0.2-0.5 g/L) to the dye bath, run 5~10 min, the bath temperature is heated to boiling at a rate of 0.5° C. per minute and held for 60 min, then the bath is cooled to about 60° C. with cold water slowly at a rate of 2° C. per minute, A color sample is taken for shade approval. Rinse to remove the loose dye and ensure good color fastness.

Then dye the cotton fiber, adding the pre-dissolved reactive dye CF-GN 2~2.8% HD-8GL 0.15~0.25%, and anhydrous sodium sulfate, to adjust the pH value to 9. The temperature is raised to 60° C. and is hold for 30 min, Add sodium chloride and sodium carbonate (45 g/L), to make pH value to 4-9 after about 30 min a sample is taken for color approval. Then make several rinses with soap to remove any surface loose color. Unload and prepare for drying after hydro extraction.

Example 3—Black 60% Modacrylic/35% Combed Cotton/5% Nylon Yarn and make the 8.8 oz/yard2 Antistatic Fabric The dyeing process is nearly same as example 1. But as the yarn is spun from 60% modacrylic and 40% combed cotton, the cationic formulations to dye the modacrylic fiber are as follows: Y x-GL 0.6-0.8%, R x-GRL 0.1-0.5% and B x-BL 0.7-0.9%, acetic acid 0.3 g/L and leveling agent 0.3 g/L. At the same time, add alkyl phosphate 0.3 g/L and LG 0.08%~~1%, anti-precipitant agent 0.3 g/L to dye the nylon.

The reactive dye formulations to dye the cotton fiber are as follows: Y M3R150% 0.2-0.6%, R 3BNJ 0.1-0.4% and B KG 10-20%, sodium chloride 70 g/L, sodium carbonate 20 g/L.

Twist the black yarn with antistatic filament (Belltron® 22T-3-B68 or 22T-3-9R1). Make the black woven antistatic fabric by using 32 s/2 yarn by 109*62/in and on every 1 cm, add one twisted antistatic yarn.

Example 4—Dark Blue Color 100% Modacrylic Yarn

The dyeing process is nearly same as example 1, but as the yarn is spun from 100% modacrylic fiber, the formulations to dye the modacrylic fiber are as follows: Y x-GL 0.2-0.4%, R x-GRL 0.1-0.5% and B x-BL 1-2%, acetic acid 0.5 g/L and leveling agent 0.3 g/L.

Example 5—Dark Blue Color 60% Modacrylic/40% Cotton with Antistatic Blend Jersey Fabric The dyeing process is nearly same as example 1, but the yarn is spun from 60% modacrylic and 40% combed cotton, the cationic formulations to dye the modacrylic fiber as follows: Y x-GL 0.2-0.4%, R x-GRL 0.1-0.5% and B x-BL 1-2%, acetic acid 0.5 g/L and leveling agent 0.3 g/L.

The reactive dyes formulations to dye the cotton fiber as follows: Y M3R150% 0.3-0.6%, R 3BNJ 0.4-0.8% and B KG 1-2%, sodium chloride 70 g/L, sodium carbonate 20 g/L.

Twist the dark blue yarn with antistatic filament (Belltron® 22T-3-B68 or 22T-3-9R1). Adding the yarn into the jersey fabric at 0.5 cm intervals.

Final in house and independent testing of the above high flame resist fabrics ensures that cotton color fastness, washing fastness, staining fastness, wet/dry rubbing fastness, perspiration fastness meets the grade 4-5 requirements;

Safety apparel made from the fabric described in the present invention comply with the EURO textile OKO-TEX STANDARD100 standards; meets EU flame retardant textiles EN11612, EN11611 standard; complies with EU Standards Association for high visibility safety clothing EN471 standard and antistatic EN1149 standards; complies with the U.S. Testing and Materials, flame retardant textiles ASTM F-1506 standard, and American National Standards Institute high visibility safety apparel (ANSI)/ISEA-107 standard.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of cheese dyeing a yarn, comprising the steps of: coning a grey yarn, loading the coned grey yarn, pretreatment, dyeing, post processing, hydro extraction, drying, coning, and packaging; wherein the yarn is composed of the percentage of components selected from the group consisting of the following recipes:

a. 60% modacrylic/40% cotton;

b. 60% modacrylic/37%-40% cotton with anti-static blend, wherein the anti-static blend is chosen from anti-static yarn or fiber and is present at ≤3%;

c. 60% modacrylic/35% cotton/5% nylon;

d. 60% modacrylic/32-35% cotton/5% nylon with anti-static blend, wherein the anti-static blend is chosen from anti-static yarn or fiber and is present at ≤3%;

e. 60% modacrylic/30-32% cotton/5% nylon/3-5% aramid;

f. 60% modacrylic/29-32% cotton/5% nylon/3% aramid with anti-static blend, wherein the anti-static blend is chosen from anti-static yarn or fiber and is present at ≤3%;

wherein the dyeing comprises 2 stages, stage 1 is dyeing the modacrylic fiber with cationic dyes; stage 2 is dyeing the cotton fibers with reactive dyes;

wherein the hydro extraction comprises reducing water content to 45%; and wherein the drying is carried out at a radio frequency (RF) drying speed of 6 m/h for 24 hours.

2. The method of claim 1, wherein the stage 1 of the dyeing further comprises using modacrylic dyeing auxiliaries and the stage 2 of the dyeing further comprises using cotton dyeing auxiliaries.

3. The method of claim 2, wherein the modacrylic dyeing auxiliaries are 0.2 to 0.5 g/L acetic acid and 0.2 to 0.5 g/L leveling agent; and the cotton dyeing auxiliaries are 30 to 50 g/L sodium chloride and 10 to 30 g/L sodium carbonate.

4. The method of claim 3, wherein the stage 1 comprises dyeing the modacrylic fiber with cationic dyes, including the steps of dissolving and heating the cationic dyes to 70° C., adding cationic auxiliaries to the dye bath, running 5-10 min, heating the bath temperature to 100° C. at a rate of 0.5° C./minute, then holding the temperature for 60 min, cooling the bath to about 60° C. with cold water at a rate of 2° C./minute, taking sample for shade approval, rinsing to remove surface dye; and the second stage comprises dyeing the cotton fiber with reactive dyes, including the steps of adding reactive dye, adjusting the pH to 9, raising the temperature to 60° C., holding the temperature for 30 min, adding sodium chloride and sodium carbonate so that the pH is 4-9, dyeing for 30 min, taking sample to approve color; rinsing several times with soap to remove excess color and ensure correct color fastness.

* * * * *